US007486011B2

(12) United States Patent
Okano et al.

(10) Patent No.: US 7,486,011 B2
(45) Date of Patent: Feb. 3, 2009

(54) THREAD-TYPE ELECTRON EMISSION ELEMENT

(75) Inventors: Makoto Okano, Saitama (JP); Tetsuya Imai, Saitama (JP); Osamu Kumasaka, Saitama (JP)

(73) Assignee: Pioneer Corporation, Tokyo (JP)

( * ) Notice: Subject to any disclaimer, the term of this patent is extended or adjusted under 35 U.S.C. 154(b) by 122 days.

(21) Appl. No.: 11/083,095

(22) Filed: Mar. 18, 2005

(65) Prior Publication Data

US 2005/0212398 A1 Sep. 29, 2005

(30) Foreign Application Priority Data

Mar. 18, 2004 (JP) ..... 2004-078311

(51) Int. Cl.
*H01J 1/62* (2006.01)

(52) U.S. Cl. ..... 313/491; 313/309; 313/336; 313/351; 313/495

(58) Field of Classification Search ..... 313/309, 313/336, 351
See application file for complete search history.

(56) References Cited

U.S. PATENT DOCUMENTS 3,822,382 A * 7/1974 Koike ..... 250/305
5,786,658 A * 7/1998 Tsukamoto et al. ..... 313/309

FOREIGN PATENT DOCUMENTS

JP 07-182967 7/1995
JP 09-007240 1/1997
RU 2028692 C1 * 2/1995

OTHER PUBLICATIONS

T.H.P. Chang, L.P. Muray, U. Staufer and D.P. Kern, "A Scanning Tunneling Microscope Based Microcolumn System," Jpn. J. Appl. Phys. vol. 31 (1992) pp. 4232-4240.

* cited by examiner

*Primary Examiner*—Joseph L Williams
(74) *Attorney, Agent, or Firm*—Nixon & Vanderhye, PC

(57) ABSTRACT

By making a cathode substrate function as a cathode and applying a voltage to the cathode and an anode, an electron emission element emits an electron from an electron source provided on the cathode substrate, and irradiates the electron onto an electron irradiation surface formed on the anode surface. The electron source is thread-type and provided on the cathode substrate. A deflecting voltage generates the electric field around the electron source. The electron source including a charge receives a power from the generated electric field to curve. Therefore, an irradiation position of the electron moves on the electron irradiation surface. Since it becomes unnecessary to move the electron irradiation surface and the electron source, a configuration of the electron emission element or an apparatus including the electron emission element is not complicated, and can be miniaturized and simple. Further, since the electron source curves, a tip of the electron source and the electron irradiation surface can be close, and a size of a beam spot at the irradiation position can be maintained constant. Therefore, since a mechanism for correcting the size of the beam spot is unnecessary, the configuration of the electron emission element or the apparatus including the electron emission element can be much simpler.

13 Claims, 5 Drawing Sheets

THREAD-TYPE ELECTRON EMISSION ELEMENT

BACKGROUND OF THE INVENTION

1. Field of the Invention

The present invention relates to an electron emission element irradiating an electron on a predetermined irradiation surface.

2. Description of Related Art

There is known a technique of applying an electron emission element to a recording and reproduction apparatus and an image display apparatus. Particularly, there is known a following technique of moving a position on an electron irradiation surface (hereinafter referred to as "irradiation posistion") at which an electron from an electron source included in the electron emission element is irradiated.

For example, there is proposed a technique of changing a recording position on a recording medium by moving the recording medium in a recording apparatus performing recording and reproduction by using an electron beam. This method is disclosed in Japanese Patent Application Laid-open under No. 9-7240. There is also proposed a technique of making an irradiation position of the electron beam movable by forming the electron source on a cantilever including a piezo-electric element and controlling a displacing timing of the cantilever and an electron emission timing of the electron source. This method is disclosed in Japanese Patent Application Laid-open under No. 7-182967. Further, there is proposed a technique to moving the irradiation position of the electron beam by deflecting the electron beam itself (see T. H. P. Chang, L. P. Muray, U. Staufer and D. P. Kern, "A Scanning Tunneling Microscope Based Microcolumn System", Jpn. J. Appl. Phys. Vol. 31 (1992) pp. 4232-4240).

However, by the above-mentioned techniques, the mechanism of the apparatus including the electron emission element and the like sometimes becomes complicated, and a configuration thereof cannot be simple. When the recording medium is moved, a complicated driving mechanism is necessary, for example. When the cantilever is used, the mechanism for driving the cantilever similarly becomes complicated. On the contrary, when the electron beam itself is deflected, a distance between a deflection unit and the electron irradiation surface has to be large in order to obtain a large deflection amount of the electron beam. Further, since the electron beam is curved, an aberration occurs to the electron beam on the electron irradiation surface, and the electron beam does not preferably converge onto the electron irradiation surface. In order to prevent it, a mechanism for correction has to be added. Therefore, the apparatus problematically becomes complicated and large.

SUMMARY OF THE INVENTION

The present invention has been achieved in order to solve the above problems. It is an object of this invention to provide an electron emission element that makes a position at which an electron is irradiated movable, and this is compactly and simply configured.

According to an aspect of the present invention, there is provided an electron emission element including: a cathode substrate; a thread-type electron emission unit which is provided on the cathode substrate and which irradiates an electron on an electron irradiation surface arranged opposite to the cathode substrate; and a deflection unit which deflects the electron emission unit by generating an electric field around the electron emission unit.

The above-mentioned electron emission element makes the cathode substrate function as a cathode, and applies the voltage to the cathode and an anode. Thereby the electron emission element emits the electron from the electron emission unit provided on the cathode substrate, and irradiates the electron on the electron irradiation surface formed on the anode surface. The electron emission unit may be the electron source for example, and is thread-type and provided on the cathode substrate. The deflection unit generates the electric field around the electron emission unit. Since the electron emission unit has a charge, it receives a power from the generated electric field. Thereby, the thread-type electron emission unit is deflected to curve, and its tip from which the electron is emitted is moved. Therefore, the position on the electron irradiation surface (hereinafter referred to as "irradiation position") at which the electron from the electron emission unit is irradiated is moved on the electron irradiation surface. Thereby, since it becomes unnecessary to move the electron irradiation surface onto which the electron is irradiated and the position of the entire electron emission unit, the configuration of the electron emission element or the apparatus including the electron emission element can be simple, not complicated.

In an embodiment of the above electron emission element, the deflection unit may include at least one pair of deflection electrodes provided in a space between the cathode substrate and the electron irradiation surface around the electron emission unit, and may deflect the electron emission unit by applying a voltage to the deflection electrode. If the plural pairs of deflection electrodes are provided, the electron emission unit becomes movable in various directions. Thereby, the movable range of the irradiation position at which the electron is irradiated can be widened. By providing two pairs of deflection electrodes in front, back, left and right directions, the tip of the electron emission unit becomes movable in an arbitrary direction on a two-dimensional surface.

In another embodiment of the above electron emission element, the electron irradiation surface may have a shape of a substantially spherical surface having a curving point of the electron emission unit as its center. The electron emission unit is deflected from the curving point by the deflection unit.

In the embodiment, if the electron emission surface is formed on the spherical surface having the curving point as its center, the distance between the point of the electron emission unit and the electron irradiation surface can be maintained constant. Thereby, a size of a beam spot at the irradiation position can be maintained constant.

In another embodiment of the above electron emission element, the deflection unit may include first deflection electrodes and second deflection electrodes in a longitudinal direction of the electron emission unit, and it may apply a voltage to the first and second deflection electrodes and may deflect the electron emission unit so that a distance between a tip of the electron emission unit and the electron irradiation surface is maintained constant.

In the embodiment, the electron emission unit is deflected by the two pairs of deflection electrodes (the first and second deflection electrodes) provided in the longitudinal direction of the electron emission unit. In this case, since the powers are applied to two portions of the electron emission unit being deflected, a degree of freedom of displacement of the electron emission unit increases. Namely, the distance between the tip of the electron emission unit and the electron irradiation surface can be adjusted. By applying the voltage suitable for the deflection electrodes, the distance between the tip of the electron emission unit and the electron irradiation surface can be maintained constant, and the electron emission unit can be deflected. Thus, the electron irradiation surface can be made plane. As a result, the electron emission element can be manufactured simply and at low cost.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings.

First Embodiment

Figure 1:
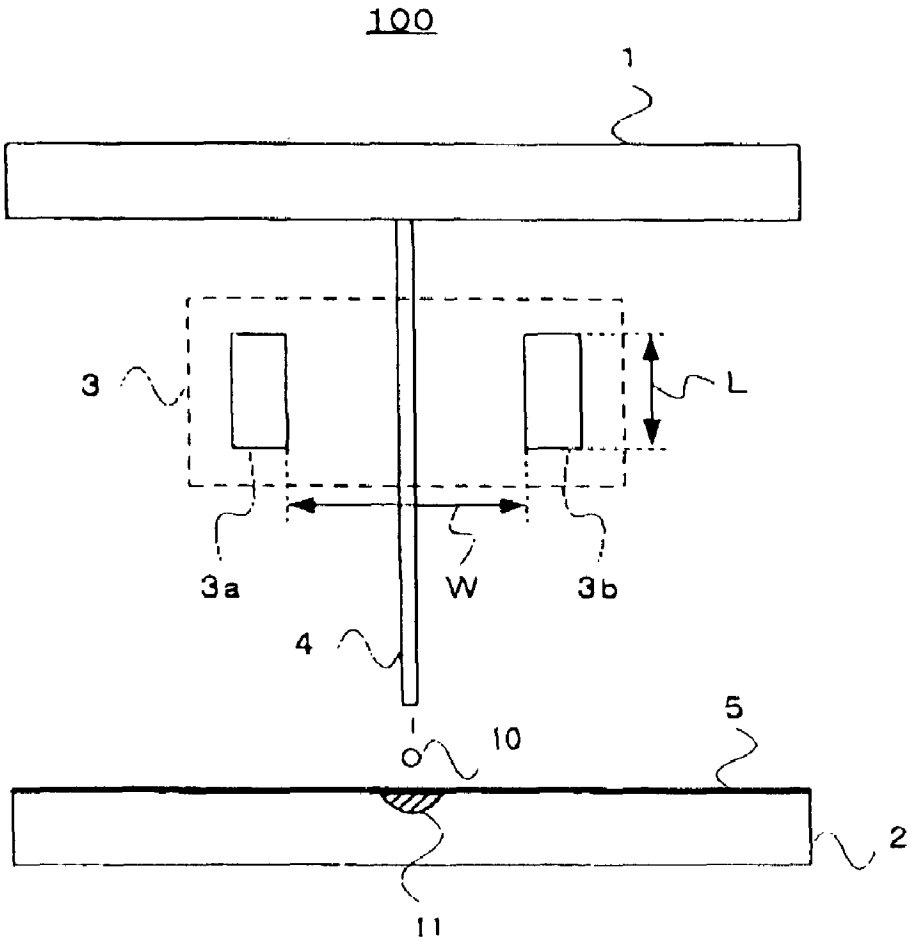
FIG. 1 is a diagram schematically showing a configuration of an electron emission element according to a first embodiment of the present invention.

First, the electron emission element according to a first embodiment of the present invention will be explained with reference to FIG. 1 to FIG. 3. FIG. 1 schematically shows a configuration of an electron emission element 100 according to the first embodiment.

As shown in FIG 1, the electron emission element 100 includes a cathode substrate 1, an electron draw-out electrode 2, deflection electrode unit 3, an electron source (electron emission unit) 4 and an electron irradiation surface 5.

The cathode substrate 1 is made of material such as silicon. A voltage is applied to the cathode substrate 1 by a power supply (not shown), and the cathode substrate 1 functions as the cathode (cold cathode) in the electron emission element 100. On the cathode substrate 1, the electron source 4 is formed.

The electron source 4 functions as the thread-type electron emission unit, and a carbon nano-tube is used as the electron source 4 for example. The carbon nano-tube is formed by an arc discharge method, a laser evaporation method or a plasma CVD method. When the carbon nano-tube is used, a diameter of the electron source 4 is 10 nm and a length thereof is 500 μm, for example. It is also possible to form an emitter chip on the cathode substrate 1 and make the carbon nano-tube grow thereon. As the electron source 4, the nano-tube made of the silicon may be used. In addition, metallic materials may be used for the material of the electron source 4.

The voltage is applied to the electron draw-out electrode 2 by the power supply (not shown), and the electron draw-out electrode 2 functions as the anode in the electron emission element 100. On a surface on which an electron 10 emitted from the electron source 4 is irradiated, the electron irradiation surface 5 is formed. The distance between the cathode substrate 1 and the electron irradiation surface 5 is set to 1 mm, for example.

As described above, the electron emission element 100 is an apparatus which emits the electron 10 from the electron source 4 provided on the cathode substrate 1 by applying the voltage to the above-mentioned cathode substrate 1 and electron draw-out electrode 2. The emitted electron 10 is irradiated onto the electron irradiation surface 5 on the electron draw-out electrode 2 (the irradiated position is referred to as "irradiation position 11" hereinafter). By using the irradiation of the electron 10, it becomes possible to record information on a recording medium, reproduce the information recorded on the recording medium and display an image on an image display apparatus.

In the present embodiment, the deflection electrode unit 3 including the deflection electrodes 3*a* to 3*d* is arranged in a space between the cathode substrate 1 and the electron irradiation surface 5, around the electron source 4. Namely, the deflection electrode unit 3 is arranged so that the electron source 4 is put between the deflection electrodes 3*a* and 3*b*. The voltage is also applied to the deflection electrodes 3*a* and 3*b* by the power supply (not shown). Thereby, between the deflection electrodes 3*a* and 3*b*, an electric field (hereinafter referred to as "deflection electric field") is generated. Charges in the electron source 4 receive a power by the deflection electric field generated by the deflection electrodes 3*a* and 3*b*. Thereby, the electron source 4 curves (deflects). As described above, the deflection electrodes 3*a* and 3*b* function as the deflection unit which deflects the electron source 4.

As shown in FIG. 1, the deflection electrodes 3*a* and 3*b* have a length L along the electron source 4, and the deflection electrodes 3*a* and 3*b* have an electrode space W between them. For example, the deflection electrodes 3*a* and 3*b* are configured such that the electrode space W is 20 μm and the length L is 10 μm.

Figure 2B:
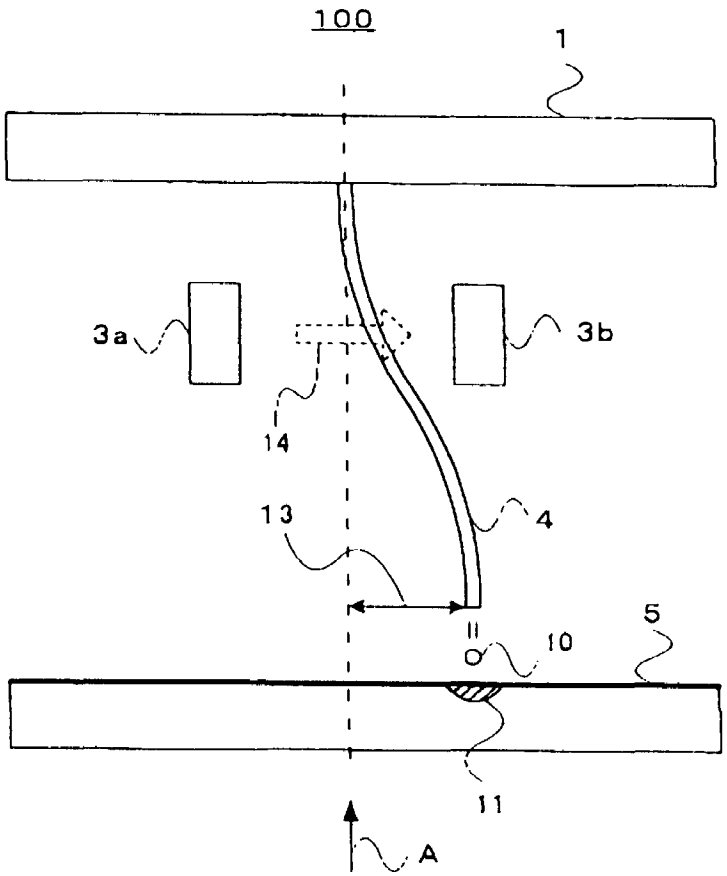
FIGS. 2A and 2B are diagrams showing states that an electron source curves by applying a voltage to deflection electrodes.
Figure 2A:
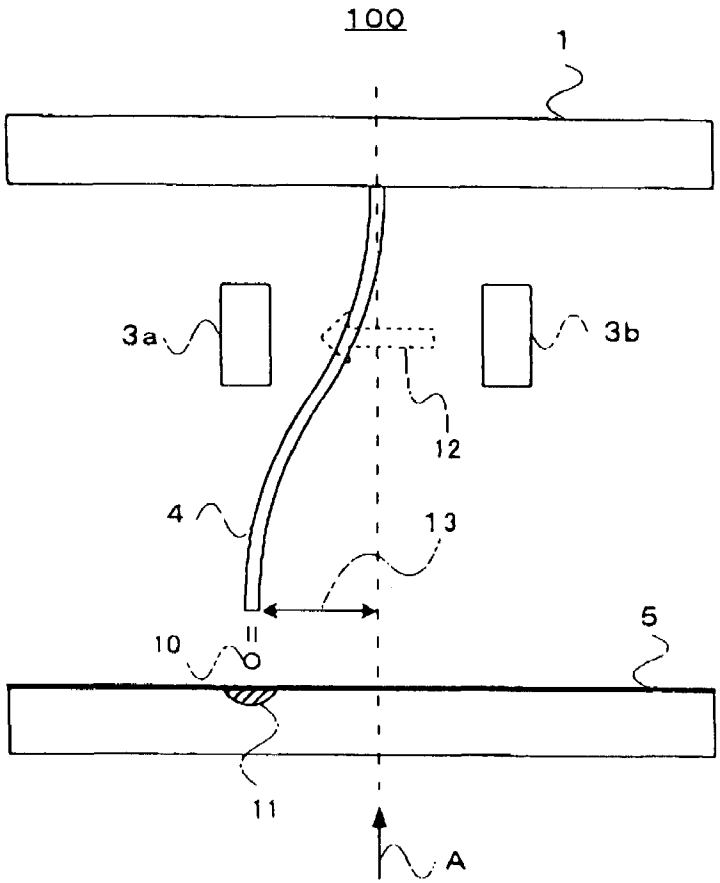

Concretely, the description will be given of a state that the electron source 4 curves, with reference to FIGS. 2A and 2B. As shown in FIG. 2A, the voltage is applied to the deflection electrodes 3*a* and 3*b* so that the deflection electrode 3*a* on the left side of FIG. 2A becomes the anode and the deflection electrode 3*b* on the right side of FIG. 2A becomes the cathode. In this case, the deflection electric field is generated between the deflection electrodes 3*a* and 3*b*, and the electron source 4 has the negative charges. Therefore, the power indicated by an arrow 12 is applied to the electron source 4. On the contrary, as shown in FIG. 2B, when the voltage is applied to the deflection electrodes 3*a* and 3*b* so that the deflection electrode 3*a* on the left side of FIG. 2B becomes the cathode and the deflection electrode 3*b* on the right side of FIG. 2B becomes the anode, the power indicated by an arrow 14 is applied to the electron source 4. As described above, by applying the voltage to the deflection electrodes 3*a* and 3*b*, the electron source 4 curves with the position on the cathode substrate 1 fixed. Thereby, the irradiation position 11 at which the electron emitted from the electron source 4 is irradiated can be moved on the electron irradiation surface 5.

An amount that the electron source 4 curves by applying the voltage to the deflection electrodes 3*a* and 3*b* (i.e., an amount shown by a reference numeral 13, and hereinafter referred to as "deflection amount 13") is determined by Young's modulus of the material included in the electron source 4, the diameter and length of the electron source 4, a charge amount in the electron source 4, a size of the deflection electrodes 3*a* and 3*b*, the electrode space between the deflection electrodes 3*a* and 3*b* and the like. For example, when the voltage of 4V is applied between the deflection electrodes 3*a* and 3*b* having the electrode space W of 20 μm and the length L of 10 μm, which is shown in FIG. 1 as an example, to deflect the electron source having the length of 500 μm and the diameter of 10 nm curves, the deflection amount 13 approximately becomes 50 μm.

Figure 3:
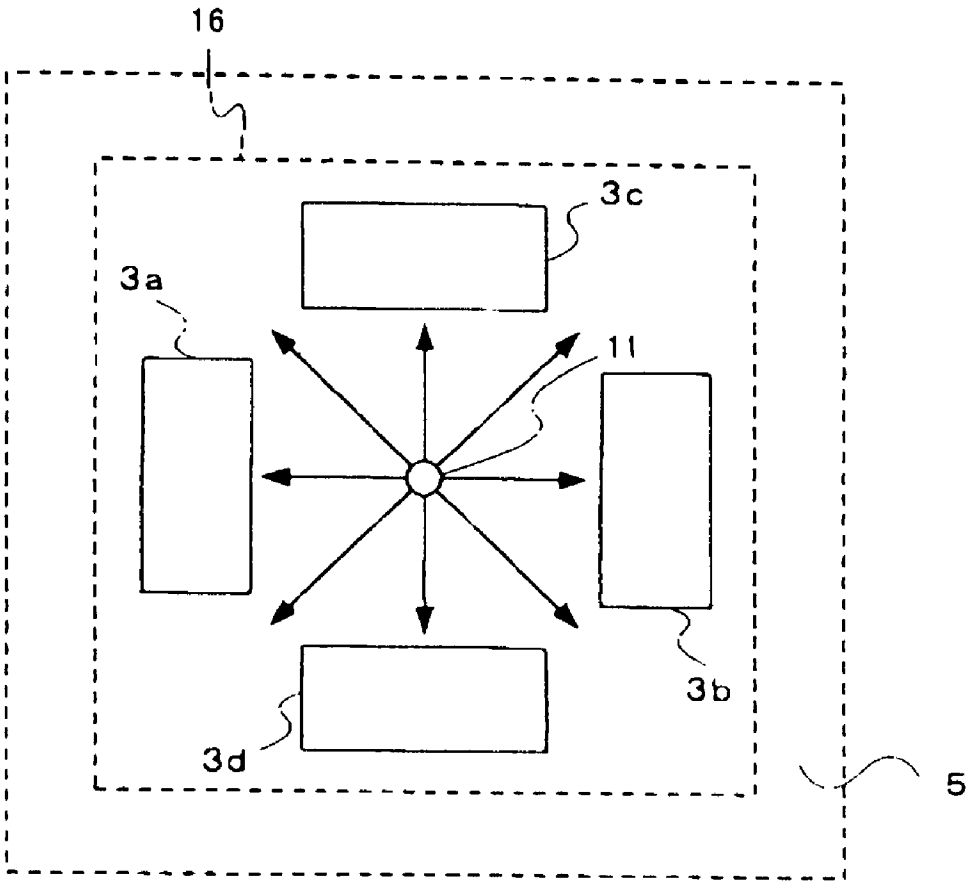
FIG. 3 is a diagram showing the electron emission element observed in a direction of an arrow A shown in FIGS. 2A and 2B.

Next, the description will be given of FIG. 3 showing the electron emission element 100 observed in the direction of an arrow A shown in FIGS. 2A and 2B. As shown in FIG. 3, the deflection electrodes 3*a* to 3*d* in the deflection electron unit 3 are arranged in four directions around the electron source 4 (upper, lower, left and right sides of the diagram). Concretely, the deflection electrodes 3*a* and 3*b* on the left and right sides of the diagram form a pair of deflection electrodes, and the deflection electrodes 3*c* and 3*d* on the upper and lower sides of the diagram form another pair of deflection electrodes. By using such deflection electrodes 3*a* to 3*d,* the irradiation position 11 by the electron source 4 is movable on the upper, lower, left and right sides of the diagram. Additionally, by changing the voltages applied to the pairs of deflection electrodes 3*a* to 3*d,* the irradiation position 11 by the electron source 4 can be moved in an oblique direction of the diagram. Thereby, the irradiation position 11 by the electron source 4 can be moved in an area shown by a broken line of the reference numeral 16. Although the electron emission element 100 according to the embodiment has two pairs of deflection electrodes 3*a* to 3*d,* the number of the pairs of deflection electrodes is not limited to two.

As described above, in the electron emission element 100 according to the present invention, by making the electron source 4 curve by the deflection electric field generated by the deflection electrode unit 3, the irradiation position 11 on the electron irradiation surface 5 can be moved. Thereby, it becomes unnecessary to move the electron irradiation surface 5 and the electron source 4 itself (in this case, it means to move a component such as the cathode substrate 1 to which the electron source 4 is attached). Therefore, the configuration of the apparatus including the electron emission element 100 is not complicated, and a miniaturized and simple configuration can be realized.

Moreover, since the electron source 4 itself curves, a tip of the electron source 4 and the electron irradiation surface 5 can be close to each other. When the electron emission element 100 is applied to a recording and reproduction apparatus, the size of the beam spot at the irradiation position 11 can be maintained constant. Therefore, it becomes unnecessary to provide a mechanism dedicated to correcting the size of the beam spot. Thereby, the apparatus including the electron emission element 100 can be configured much simpler.

Second Embodiment

Next, the description will be given of an electron emission element 101 according to a second embodiment of the present invention with reference to FIGS. 4A and 4B.

Figure 4B:
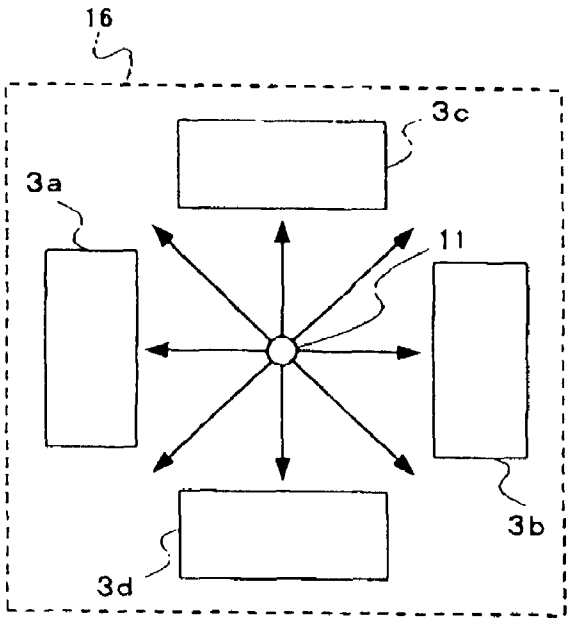
FIGS. 4A and 4B are diagrams schematically showing a configuration of the electron emission element according to a second embodiment of the present invention.
Figure 4A:
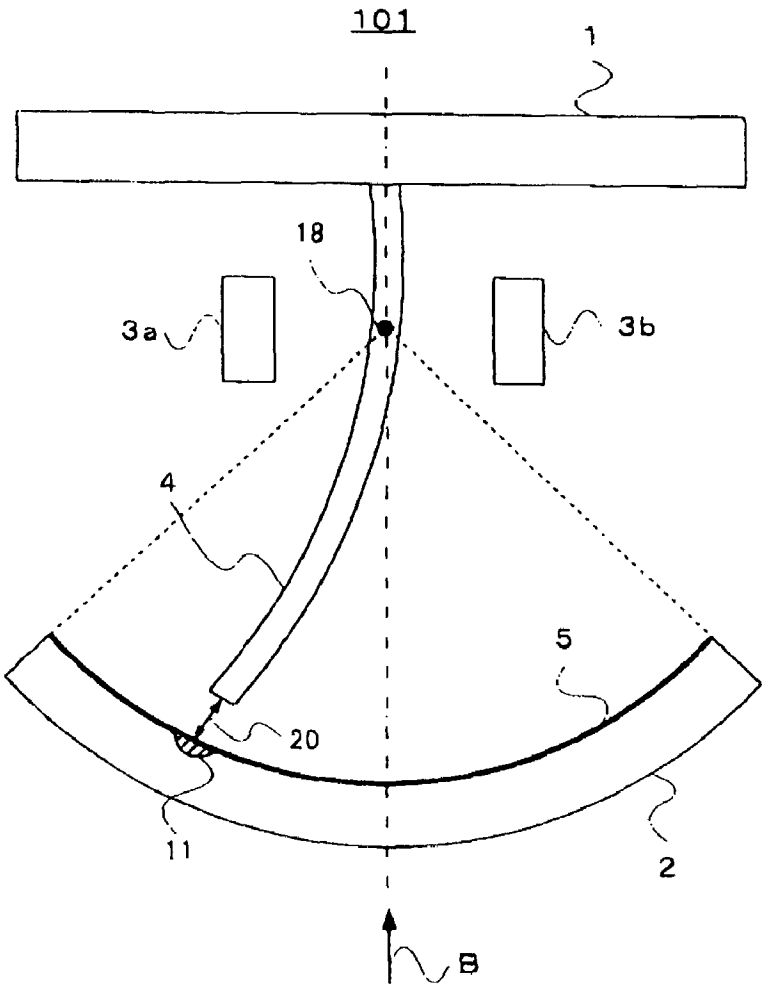

As shown in FIG. 4A, the electron emission element 101 also includes the cathode substrate 1, the electron draw-out electrode 2, the deflection electrode unit 3, the electron source 4, and the electron irradiation surface 5, similarly to the first embodiment. Since the materials and the functions of them in the electron emission element are similar to those shown in the first embodiment, an explanation thereof is omitted.

FIG. 4B is a diagram showing the electron emission element 101 observed in a direction of an arrow B of FIG. 4A. As shown in FIG. 4B, the electron emission element 101 according to the second embodiment also includes the deflection electrode unit 3 including the pair of deflection electrodes 3*a* and 3*b* and the pair of deflection electrodes 3*c* and 3*d* around the electron source 4. Thereby, the electron source 4 is curved by the deflection electrodes 3*a* to 3*d,* and the irradiation position 11 is movable in the area 16.

In the electron emission element 101 according to the second embodiment, the shapes of the electron draw-out electrode 2 and the electron irradiation surface 5 are different from the shapes shown in the first embodiment. As shown in FIG. 4A, the electron draw-out electrode 2 and the electron irradiation surface 5 are shaped like a portion of a substantially spherical surface having a curving point 18 of the electron source 4 as its center. The curving point 18 is a center point when the electron source 4 curves.

As described above, when the electron draw-out electrode 2 and the electron irradiation surface 5 are shaped like a portion of the substantially spherical surface having its center at the curving point 18, since the electron source 4 curves from the curving point 18, a distance 20 between the tip of the electron source 4 and the electron irradiation surface 5 is maintained constant. Thereby, to whichever direction the electron source 4 curves, the size of the beam spot at the irradiation position 11 can be maintained constant. Therefore, when the electron emission element 101 is applied to the recording and reproduction apparatus for example, improvement of recording accuracy of the information and high-density recording onto the recording medium can be realized.

Third Embodiment

Next, the description will be given of an electron emission element 102 according to a third embodiment of the present invention with reference to FIG. 5.

Figure 5A:
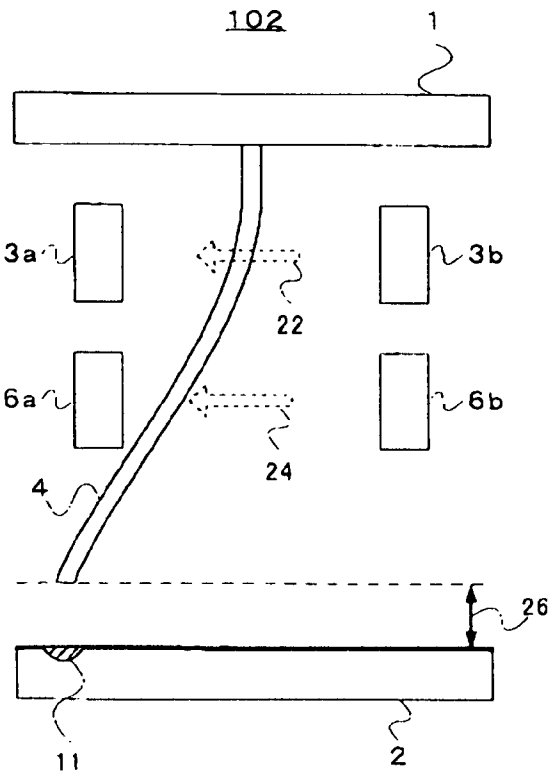
FIGS. 5A to 5C are diagrams schematically showing configurations of the electron emission element according to a third embodiment of the present invention.
Figure 5B:
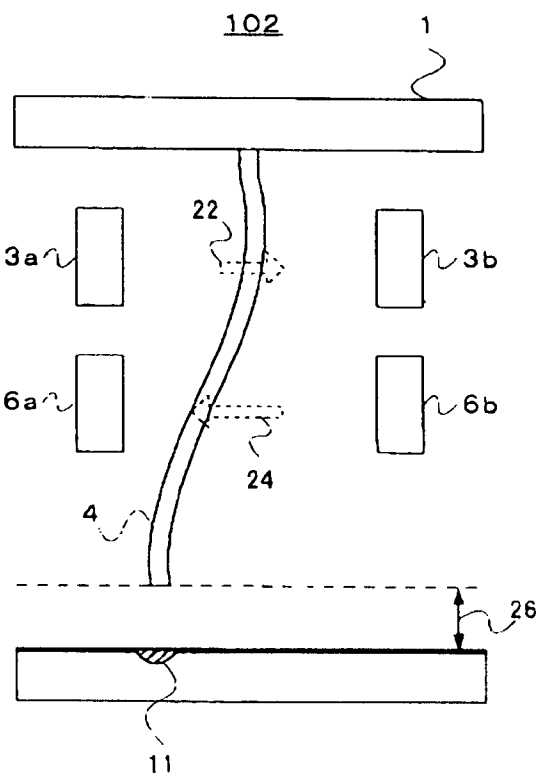
Figure 5C:
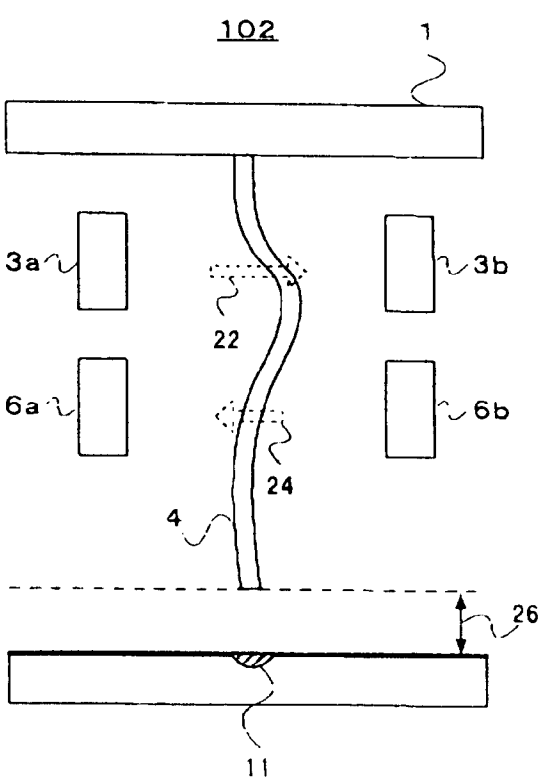

As shown in FIGS. 5A to 5C, the electron emission element 102 includes the cathode substrate 1, the electron draw-out electrode 2, the deflection electrode unit 3, a deflection electrode unit 6, the electron source 4 and the electron irradiation surface 5. The electron emission element 102 according to the third embodiment is different from the above-mentioned electron emission elements 100 and 101 in the first and second embodiments in that the deflection electrodes are provided at two positions in the longitudinal direction of the electron source 4. Since other components of the electron emission element 102 are similar to the above-mentioned components in the first and the second embodiments, an explanation thereof is omitted.

The deflection electrode units 3 and 6 according to the third embodiment include the deflection electrodes 3*a* and 3*b* and 6*a* and 6*b* provided in the longitudinal direction of the electron source 4. The deflection electrode unit 3 includes the deflection electrodes 3*a* and 3*b,* and the deflection electrode unit 6 includes the deflection electrodes 6*a* and 6*b.* Namely, the deflection electrodes 3*a* and 3*b* function as the first deflection electrodes, and the deflection electrodes 6*a* and 6*b* function as the second deflection electrodes.

Concretely, the description will be given of a state that the electron source 4 curves when the voltage is applied to the deflection electrodes 3*a,* 3*b,* 6*a* and 6*d.* As shown in FIGS. 5A to 5C, if the voltage is applied to the deflection electrodes 3*a* and 3*b,* they generate the deflection electrified, and give, to the electron source 4, a power shown by an arrow 22. The deflection electrodes 6*a* and 6*b* at the lower portion of the deflection electrode 3 in the diagram give, the electron source 4, a power shown by an arrow 24. Like this, the powers are given to two portions of the electron source 4 by the deflection electrodes 3*a,* 3*b,* 6*a* and 6*b.* Therefore, it becomes possible that the electron source 4 curves at the two portions.

An operation of the present embodiment will concretely be explained. When the large deflection is to be performed as shown in FIG. 5A, the voltage of the same polarity is applied to the deflection electrodes 3*a* and 3*b* and the deflection electrodes 6*a* and 6*b*. In the configuration of the first embodiment, as the deflection amount decreases, a distance between the tip of the electron source 4 and the electron irradiation surface 5 becomes small. However, in the configuration of the present embodiment, by applying the voltages of the different polarities to the deflection electrodes 3*a* and 3*b*, and the deflection electrodes 6*a* and 6*b*, respectively, curves can be generated at the two portions of the electron source 4 shown in FIGS. 5A to 5C. As a result, as shown in FIG. 5B, the deflection amount can be reduced with maintaining the distance 26 between the tip of the electron source 4 and the electron irradiation surface 5 in a case that the deflection amount is large. Moreover, when the deflection amount is to be reduced, by suitably controlling the applied voltage, it becomes possible that the deflection amounts of the two portions are increased and the distance 26 between the tip of the electron source 4 and the electron irradiation surface 5 is maintained, as shown in FIG. 5C.

It is noted that the control of the voltages applied to the deflection electrodes 3*a*, 3*b*, 6*a* and 6*b* can be executed by a control apparatus (not shown.) When the electron emission element 102 is loaded on other apparatus, the control can be executed by a CPU and the like included in the apparatus.

As described above, in the electron emission element 102 according to the third embodiment, by curving the two portions of the electron source 4 by the deflection electrodes 3*a*, 3*b*, 6*a* and 6*b* provided at two sections in the longitudinal direction of the electron source 4, the distance 26 between the tip of the electron source 4 and the electron irradiation surface 5 can be maintained constant. Therefore, the size of the beam spot at the irradiation position 11 and a beam current can be maintained constant. Unlike the second embodiment, since each shape of the electron irradiation surface 5 and the electron draw-out electrode 2 can be made not like the one portion of the substantially spherical but plane, the electron emission element 102 can be formed easily and at a low price.

In the electron emission element 102 according to the third embodiment, as shown in FIG. 3 and FIG. 4B, the two pairs of deflection electrodes may be arranged around the electron source 4. Namely, the deflection electrode unit 3 may include two pairs of deflection electrodes, and the deflection electrode unit 6 may include two pairs of deflection electrodes. The number of the pairs may be different at the upper and lower portions, i.e., the deflection electrode unit 3 includes two pairs, and the deflection electrode 6 includes one pair. Furthermore, the number of sections of deflection electrodes provided in the lonqitudinal direction of the electron source 4 is not limited to the above-mentioned number.

The electron emission element of the present invention can be applied to the recording and reproduction apparatus which records the information on the recording medium, and a general apparatus which irradiates the electron in a minute area such as an electron beam exposure apparatus, a minute area electron beam hardening resin hardening apparatus and the like, for example. However, the application of the electron emission element of the present invention is not limited to the above embodiments.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2004-78311 filed on Mar. 18, 2004 including the specification, claims, drawings and summary is incorporated herein by reference in its entirety.

What is claimed is:

1. An electron emission element comprising:

a cathode substrate;

a thread-type electron emission unit which is provided on the cathode substrate and which irradiates an electron on an electron irradiation surface arranged opposite to the cathode substrate;

a deflection unit which deflects the electron emission unit by generating an electric field around the electron emission unit; and a control unit which controls a voltage applied to the deflection unit so that the electron is irradiated at a predetermined position on the electron irradiation surface.

2. The electron emission element according to claim 1, wherein the deflection unit includes at least one pair of deflection electrodes provided in a space between the cathode substrate and the electron irradiation surface around the electron emission unit.

3. The electron emission element according to claim 1, wherein the electron irradiation surface has a shape of a substantially spherical surface having a curving point of the electron emission unit as a center.

4. The electron emission element according to claim 1, wherein the deflection unit includes first deflection electrodes provided at a first position and second deflection electrodes provided at a second position different from the first position in in a longitudinal direction of the electron emission unit, and wherein the deflection unit applies a voltage to the first and second deflection electrodes and deflects the electron emission unit so that a distance between a tip of the electron emission unit and the electron irradiation surface is maintained constant.

5. The electron emission element according to claim 1, wherein the thread-type electron emission unit emits the electron from its tip part.

6. An electron beam exposure apparatus comprising the electron emission element according to claim 1.

7. A recording and reproduction apparatus for recording data onto and reproducing data from a recording medium, the apparatus comprising the electron emission element according to claim 1.

8. An image display apparatus comprising the electron emission element according to claim 1.

9. An electron emission element comprising:

a thread-type electron emission unit arranged to irradiate electrons on an electron irradiation surface;

a deflection unit which selectively deflects the thread-type electron emission unit while maintaining a substantially constant distance between a tip of the thread-type electron emission unit and the electron irradiation surface; and a control unit which controls a voltage applied to the deflection unit so that the electrons are irradiated at a specified position on the electron irradiation surface.

10. The electron emission element according to claim 9, wherein the deflection unit comprises first and second pairs of deflection plates, the first pair of deflection plates being longitudinally displaced relative to the second pair of deflection plates.

11. The electron emission element according to claim 10, wherein the first and second pairs of deflection plates are operable to apply respective forces to the thread-type electron emission unit in the same or opposite directions.

12. An electron emission element comprising:

a thread-type electron emission unit arranged to irradiate electrons on a curved electron irradiation surface;

a deflection unit which selectively deflects the thread-type electron emission unit; and a control unit which controls a voltage applied to the deflection unit so that the electrons are irradiated at a specified position on the curved electron irradiation surface.

13. The electron emission element according to claim 12, wherein the deflection unit comprises first and second pairs of deflection plates.

* * * * *